United States Patent [19]

Beckstead

[11] 4,037,495

[45] July 26, 1977

[54] FLEXIBLE STRAP WRENCH

[76] Inventor: Donald M. Beckstead, 4944 No. 13 Navy Road, Millington, Tenn. 38053

[21] Appl. No.: 703,987

[22] Filed: Aug. 27, 1976

[51] Int. Cl.[2] ..... B25B 13/52

[52] U.S. Cl. ..... 81/64

[58] Field of Search ..... 81/64, 3.4, 3.43

[56] References Cited

U.S. PATENT DOCUMENTS

| | | | |
|---|---|---|---|
| 988,780 | 4/1911 | Horwath | 81/3.43 |
| 1,383,123 | 6/1921 | Jones | 81/64 |

FOREIGN PATENT DOCUMENTS

| | | | |
|---|---|---|---|
| 110,710 | 5/1944 | Sweden | 81/64 |

*Primary Examiner*—James L. Jones, Jr.
*Attorney, Agent, or Firm*—R. S. Sciascia; G. J. Rubens

[57] ABSTRACT

A wrench is provided for removing or installing any rotatable member, such as an electrical cannon type plug that is accessible only from a position substantially along the rotational axis and in a manner that will not distort or damage the member.

6 Claims, 5 Drawing Figures

FLEXIBLE STRAP WRENCH

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to a wrench-like tool, and more particularly to such a tool having a flexible strap material that can be releasably clamped around the object to be rotated.

In the testing, troubleshooting, and repairing of electrical systems it is frequently necessary to remove or install a rotatable member, such as a cannon plug located in such a compact area, i.e., in the vicinity of adjacent plugs or other equipment, that it is impossible to grasp the plug from a lateral side position, such as by a conventional pliers or like instrument. In other words, the plug is accessible only from a position directly in front thereof.

Another problem resides in the fact that conventional wrenches can be tightened excessively about the object to be rotated during the installation or removal operations so as to distort or otherwise damage the object.

SUMMARY OF THE INVENTION

The novel wrench-like device comprises a flexible strap having free ends to which is attached "VELCRO" strips. The strap is intermediately supportable by a shaft. The free ends of the strap can be adjustably connected to form a loop, depending on the diameter of the object to be rotated, which loop can be slipped around the periphery of the object and tightened thereto by twisting the shaft. The shaft has a bifurcated end slideably to receive the strap at an intermediate position, and suitably secured thereto, such as by a rivet. The other end of the shaft terminates in a handle portion extending normal thereto to enable the looped strap through the shaft to be torqued in either a clockwise or counter clockwise rotation depending on whether the object is to be tightened or loosened.

STATEMENT OF THE OBJECTS OF THE INVENTION

A principal object of the invention is to provide a wrench-like tool that can be rotated from a position along the rotational axis of the member to be rotated, and a corollary object is to provide such a device which can be rotated either clockwise or counter clockwise.

Another important object is to provide such a wrench-like member which contains a flexible strap which can be adjusted in diameter to be slipped over different sizes of objects to be rotated without damage thereto.

Other objects, advantages and novel features of the invention will become apparent from the following detailed description of the invention when considered in conjunction with the accompanying drawings.

DESCRIPTION OF THE PREFERRED EMBODIMENT

Figure 1:
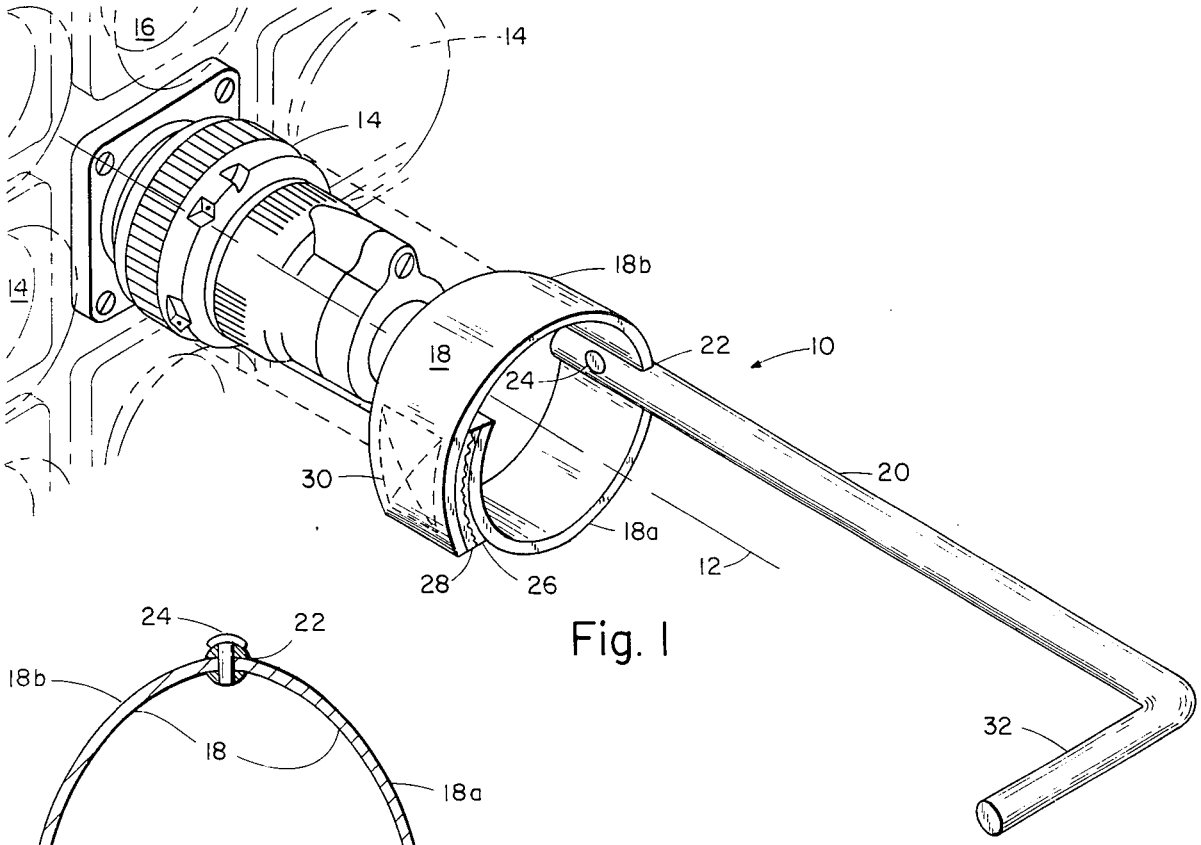
FIG. 1 is an isometric view of the novel wrench with the strap in a looped condition poised in an aligned position with respect to a chassis mounted cannon electrical plug to be rotated thereby.
Figure 2:
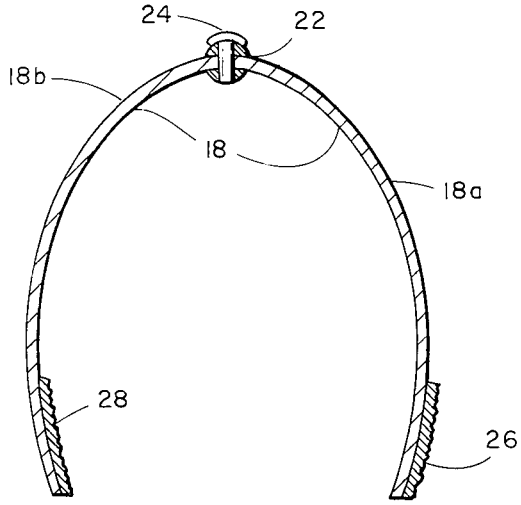
FIG. 2 is an end view of the flexible strap with its ends in a relaxed open position.

Referring to the drawing where like reference numerals refer to similar parts throughout the figures, there is shown in FIG. 1 a novel wrench-like tool 10 in a position aligned with the rotational axis 12 of a "cannon" type electrical plug 14 mounted to a conventional chassis 16 or the like. Cannon plug 12 is shown in the midst of a plurality of other plugs or similar devices, shown in fathom lines. It should be understood that the "cannon" plug is illustrative of only one type of object that can be rotated by tool 10.

Tool 10 comprises a flexible strap 18 for clamping the article and an elongate shaft 20 for ratating the strap. The strap can be made of any suitable material having a high tensile strength, such as a woven fabric. Strips 26 and 28 made of "VELCRO" material are sewn at 30 to the inside and outside faces of strap ends **18*a* and 18*b*** for adjustably varying the diameter of the looped strap when the strips are pressed together. When pressed together, a predetermined amount of shear force applied to the loop strap will cause the strips to separate. It should be noted that the strap will conform to different shaped objects other than a cylindrical configuration.

One end 22 of the shaft is bifurcated slideably to receive an intermediate portion of strap 18 which is secured thereto by a rivet 24. The portion of the shaft where bifurcated should be cylindrical in cross-section for a purpose to be described. The other end of shaft 20 is bent normal thereto to form a handle 32. The length of shaft 20 will depend on the height of the object which is to be rotated, and the length of strap 18 will depend on the maximum diameter of the object to be rotated.

The use of tool 10 is apparent from the drawing. Although the tool is particularly suitable for use in manipulating objects in a confined area, its use is not so limited as it can be used in rotating fragile objects where it is desirable to limit the amount of torque that should be applied.

Figure 3:
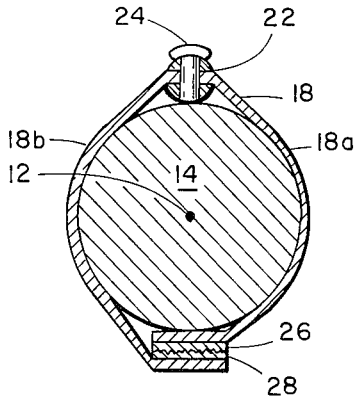
FIGS. 3, 4 and 5 are end views of the flexible strap secured looped around the cannon plug in a neutral position, a clockwise tightening position and a counter clockwise loosening position, respectively.
Figure 5:
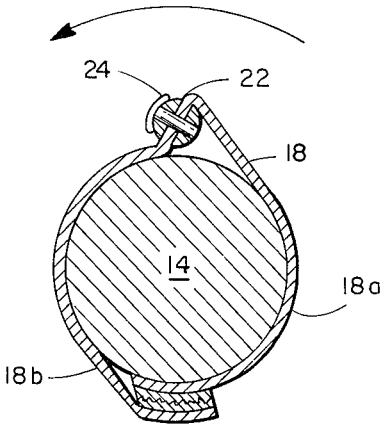

To remove cannon plug 14 from classis 16, the free ends of the strap are brought together by the operator, and strips 26 and 28 pressed together to form the strap loop in FIG. 1. The diameter of the strap loop should be chosen to slip around the plug in a snug fit, such as is represented in FIGS. 1 and 3. Assuming plug 14 to be removed has right hand threads or prongs, with the tool mounted in position around the plug, as shown in FIG. 3, handle 32 is twisted counter-clockwise as shown in FIG. 5. This movement causes the diameter of the strap loop to be initially tightened and grip the plug, to enable the further applied torque to rotate the plug and permit its removal. It should be noted that the cylindrical bifurcated end of the shaft is able to roll over the strap and plug.

Figure 4:
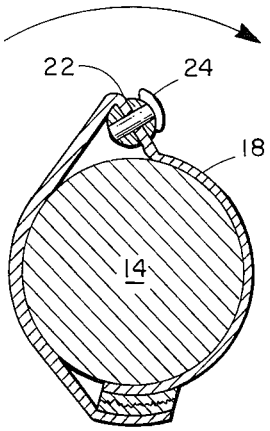

To insert a plug into its socket, the plug is first inserted into the looped strap, and the tool and plug aligned with its respective socket. A clockwise torque is applied as shown in FIG. 4 to secure the plug in the socket.

An important aspect of the tool is that by use of the "VELCRO" strips to secure the looped strap it is impossible for the operator to apply an excessive torque to the plug in the tightening operation, which will eliminate any problem in the loosening operation. This is so because the "VELCRO" strips when pressed together will separate upon the application of a predetermined amount of shear force.

Accordingly, the novel tool of this invention offers many advantages. Not only is the tool compact, lightweight and inexpensive to construct, it is also simple to apply, and will expedite repairs and eliminate damage to the objects being rotated.

Obviously many modifications and variations of the present invention are possible in the light of the above teachings. It is therefore to be understood that within the scope of the appended claims the invention may be practiced otherwise than as specifically described.

I claim:

1. A tool for rotating an object comprising:

a flexible strap having two free ends capable of being formed into a loop to receive the object to be rotated;

means for adjustably securing together the free ends of said strap;

a shaft secured to said strap intermediate the ends and extending in a direction normal to a peripheral plane containing said loop;

whereby objects can be rotated from an axially remote position.

2. The tool of claim 1 wherein said securing means comprises a strip of "VELCRO" material.

3. The tool of claim 2 wherein said "VELCRO" strip is secured to both ends of said strap.

4. The tool of claim 2 wherein said shaft terminates at an end opposite the strap end with a portion extending substantially normal thereto forming a handle portion.

5. The tool of claim 2 wherein said shaft is formed within a bifurcated end to receive said strap which is secured therein.

6. The tool of claim 2 wherein said shaft adjacent said flexible strap has a cylindrical configuration to enable it to be rolled with respect to the object.

* * * * *